US011383881B2

(12) United States Patent
Leboucher

(10) Patent No.: US 11,383,881 B2
(45) Date of Patent: Jul. 12, 2022

(54) PANEL, AND A CONTAINER BODY AND A CONTAINER PROVIDED WITH SUCH PANEL

(71) Applicant: Ardagh MP Group Netherlands B.V., Deventer (NL)

(72) Inventor: Fabrice Leboucher, Angers (FR)

(73) Assignee: Ardagh MP Group Netherlands B.V., Deventer (NL)

( * ) Notice: Subject to any disclaimer, the term of this patent is extended or adjusted under 35 U.S.C. 154(b) by 379 days.

(21) Appl. No.: 14/364,503

(22) PCT Filed: Dec. 20, 2012

(86) PCT No.: PCT/EP2012/076454
§ 371 (c)(1),
(2) Date: Jun. 11, 2014

(87) PCT Pub. No.: WO2013/092899
PCT Pub. Date: Jun. 27, 2013

(65) Prior Publication Data

US 2014/0346174 A1 Nov. 27, 2014

(30) Foreign Application Priority Data

Dec. 20, 2011 (EP) ..... 11194653

(51) Int. Cl.
*B65D 17/00* (2006.01)
*B65D 17/28* (2006.01)

(52) U.S. Cl.
CPC ..... *B65D 17/02* (2013.01); *B65D 17/4012* (2018.01); *B65D 2517/0071* (2013.01); *B65D 2517/0077* (2013.01); *B65D 2517/0089* (2013.01); *B65D 2517/5091* (2013.01)

(58) Field of Classification Search
CPC ..... B65D 17/34; B65D 17/165; B65D 17/02; B65D 2517/0089; B65D 2517/5091; B65D 2517/0077; B65D 2517/0071
USPC ..... 220/269
See application file for complete search history.

(56) References Cited

U.S. PATENT DOCUMENTS 3,307,737 A * 3/1967 Harvey ..... B65D 17/16 220/231
3,499,573 A * 3/1970 Adams ..... B65D 17/163 220/271
3,543,391 A * 12/1970 John ..... B21D 51/383 220/273

(Continued)

FOREIGN PATENT DOCUMENTS

EP 0639507 A1 2/1995
JP 58177325 U 11/1983

(Continued)

*Primary Examiner* — Anthony D Stashick
*Assistant Examiner* — Blaine G Neway
(74) *Attorney, Agent, or Firm* — The Webb Law Firm

(57) ABSTRACT

The present invention relates to a panel including a peripheral edge to be connected to a container body of a container, and a tab connected to the panel, which tab includes a front tab part and a rear tab part for gripping and forming an opening in the panel, wherein the panel is provided with means preventing an external can structure to engage with the rear tab part, and to a can body and a can including such a panel.

9 Claims, 4 Drawing Sheets

(56) References Cited

U.S. PATENT DOCUMENTS 3,704,805 A * 12/1972 Sheafe, III ..... B65D 17/165 220/273
3,795,342 A 3/1974 Ashton
3,838,788 A 10/1974 Stargell
3,938,693 A * 2/1976 Patel ..... B65D 17/18 220/268
3,938,696 A * 2/1976 Herbst ..... B65D 79/005 220/273
3,986,631 A * 10/1976 Ostrem ..... B65D 17/163 220/270
3,986,633 A * 10/1976 Jordan ..... B65D 17/163 220/273
4,165,017 A * 8/1979 Hasegawa ..... B65D 17/165 220/273
4,202,287 A * 5/1980 Zundel ..... B21D 51/383 29/524.1
4,205,760 A * 6/1980 Hasegawa ..... B65D 17/165 220/271
4,685,849 A * 8/1987 LaBarge ..... B21D 51/383 220/240
D332,402 S * 1/1993 Harwood ..... D9/438
5,927,535 A * 7/1999 Goth ..... B65D 47/0847 220/254.3
8,371,471 B2 * 2/2013 Khowaylo ..... A47J 41/0072 220/592.16
2005/0082291 A1 * 4/2005 Emmerzaal ..... B65D 17/24 220/270
2007/0108208 A1 * 5/2007 Dickie ..... B65D 17/165 220/269
2010/0108679 A1 * 5/2010 Leboucher ..... B65D 17/163 220/270
2010/0163560 A1 * 7/2010 Leboucher ..... B65D 17/161 220/285
2011/0006065 A1 * 1/2011 Leboucher ..... B65D 17/165 220/270
2012/0279967 A1 * 11/2012 Leboucher ..... B65D 17/163 220/265
2014/0346174 A1 * 11/2014 Leboucher ..... B65D 17/165 220/269

FOREIGN PATENT DOCUMENTS

JP 2152667 A 6/1990
JP 2000128168 A 5/2000
JP 2004161360 A 6/2004
JP 4776430 B2 9/2011
JP 2012236624 A 12/2012
WO 2010012947 A2 2/2010

* cited by examiner

PANEL, AND A CONTAINER BODY AND A CONTAINER PROVIDED WITH SUCH PANEL

CROSS-REFERENCE TO RELATED APPLICATIONS

This application is the United States national phase of International Application No. PCT/EP2012/076454 filed Dec. 20, 2012, and claims priority to European Patent Application No. 11194653.9 filed Dec. 20, 2011, the disclosures of which are hereby incorporated in their entirety by reference.

BACKGROUND OF THE INVENTION

Field of the Invention

The present invention relates to a panel, to a container body provided with such panel and to a container provided with such panel.

Description of Related Art

A panel is used for closing a container. Such panel if often provided with a tab for forming an opening in the container and thereby providing access to the content of the container. The tab is thereto attached to the panel. The attachment may be by via soldering or gluing but generally via a rivet. The rivet may be a separate element or formed from and is integral with the panel.

The tab comprises a rear tab part, a front tab part and a central tab part at which central tab part the tab is attached to the panel. The rear tab part is to be gripped by the user and to be lifted for forming the opening in the panel. The lifting of the rear tab part results in a pressing action of the front tab part onto the panel and the formation of an opening in the panel along a score formed in the panel.

The construction and the form of the panel may be such that the rear tab part is either in contact or at some clearance or distance from the panel surface.

The panel is mounted on the container (body) after filling. The filled and closed container may be subjected to a heat or sterilization treatment. The heating of the container will result in a pressure increase and bulging of the panel. This bulging may result in a lifting of the rear tab part from the panel surface, or if there is already a clearance between the front tab part and the panel surface, in an increase of the clearance or distance.

Applicant has been confronted with situations wherein such clearance between the rear tab part and the panel has resulted in an engagement or hooking of external can structures behind the rear tab part. Such external can structure may be another panel hooking with a panel peripheral edge or the rear tab part of the other panel. In case of filled cans the external structure may be a container body rim or the upstanding rear tab part of anther container, such as during a heat treatment. Also in case the penal connected to a container body prior to filling similar hooking problems could occur.

The present invention has for its object to provide a panel for which there exists substantially no risk for the above described engagement or hooking when the rear tab part is at some distance from the panel surface either as separate panels or as panels mounted on a container body or as part of a filled container. Still such panel should manufactured with standard manufacturing means, generally not requiring additional tools and not interfering with the production and with the function of the panel particularly with the gripping and lifting of the rear tab part for opening the container.

SUMMARY OF THE INVENTION

This objective is met by the present invention with the provision of a panel comprising a peripheral edge to be connected to a container body of a container, and a tab connected to the panel, which tab comprises a front tab part and a rear tab part for gripping and forming an opening in the panel, wherein the panel is provided with means preventing an external can structure to engage with the rear tab part.

The present invention is based on the insight that by providing means that prevent an external can structure to penetrate into the clearance or space between the rear tab part and the panel surface that the hooking problem is substantially, if not fully, avoided. Thus, the prevention means extend in front of the clearance or also beneath the clearance. Under all circumstances in a manner that the external can structure cannot engage with the tab rear part. Since the prevention means do not extend outside of the (theoretical) envelope of the panel, there will be substantially no interference in the manufacturing process of the panel and not in the manufacture of the can.

In a first embodiment the prevention means comprise at least one emboss extending at least adjacent and preferably also beneath the rear tab part. Such an emboss can be formed with standard tools into the panel surface during its manufacture. Even before or after connecting the tab to the panel. The emboss is shaped and arranged such that external can structures, in particular other tabs or can rims and can edges cannot engage with the rear tab part. If such requirement cannot or less reliably met with one emboss, then the invention foresees the application of more than one emboss. It is noted that a finger access may not be required when the rear tab part can be reached by fingers via an opening in the tab between the rear tab part and the central tab part.

According to another embodiment the prevention means comprise at least two embosses extending spaced apart sidewise, thus adjacent and preferably also beneath of the rear tab part. When using two embosses spaced apart with an opening between the two embosses and free end of the rear tab part and the panel surface, this opening allows for a finger access for gripping the rear tab part.

Obviously, for the other embodiment the spacing between the two embosses is selected in view of external can structure. The spacing may be smaller for sharp forms of other tabs, and wider for curved parts of the can body and can, such as rims and peripheral edges. Accordingly, it is preferred that the spacing between the two embosses is such that the external can structure cannot penetrate beneath the rear tab part, but allowing finger access.

In order to avoid engagement or hooking of an external can structure with the rear tab part, it is preferred that either the emboss or an emboss part extending adjacent the rear tab part extends over a height at least equal to the height of the underside of the rear tab part or the emboss or an emboss part extending adjacent the rear tab part extends over a height maximally equal to the height of the upper side of the rear tab part. According to both embodiments any penetration of an external can structure beneath the rear tab part and the panel surface is obstructed by the dimension of the emboss or emboss part.

As indicated here and before the production of the panel or the production of the filled can may be such that the clearance or distance in between the rear tab part and the panel surface is not constant but may change during the manufacture of the panel or after the filling and closing of the can. Accordingly, the height of the rear tab part underside or rear tab part upper side is the relevant height during, production, filling, cooking, and storage of the panel and/or the can. The height of the emboss or emboss part is therefore adjusted to the maximum height the rear tab part may have during the production of the panel and/or after the closure of the can.

As indicated here and before the rear tab part may be gripped by a finger of the user via an opening which is generally present in the rear tab part. Evidently, gripping of the rear tab part may be improved or desired by the user not only via this rear tab part opening but also via the free end of the rear tab part. Accordingly, it is preferred that the free end of the rear tab part the panel is provided with an indent thereby forming a finger access.

According to another aspect the invention also relates to a container body provided at the container body end via a peripheral panel edge with a panel with a panel as described here and before.

Still, according to another aspect the invention relates to a container comprising a panel and/or container body as described here and before. Such a container being filled and closed with a panel according to the invention, may have a clearance between the rear tab part and panel, but still any engagement or hooking with an external can structure is avoided. Such a clearance may preferably be formed by a negative pressure difference between the inner pressure and the outer pressure there is a clearance between the rear tab part and the panel.

BRIEF DESCRIPTION OF THE DRAWINGS

Mentioned and other features of the present invention will be further discussed and illustrated by the following description of several embodiments of the present invention without the intention to restrict the invention to these embodiments. In this respect reference will be made to the annex drawings wherein.

DESCRIPTION OF THE INVENTION

Figure 1:
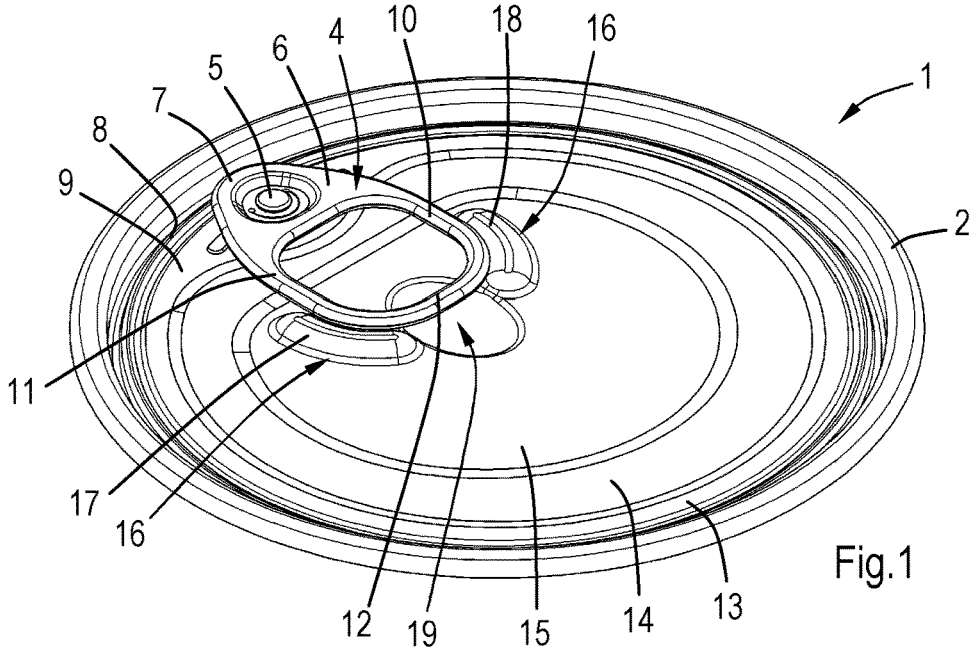
FIG. 1 is a perspective view of a panel according to the invention.

FIG. 1 discloses a panel 1 according to the invention. The panel 1 comprises a peripheral edge to be connected to a container body (see FIG. 13) of a container. A tab 4 is connected to the panel 1 via a rivet 5 which is located in the central part 6 of the tab 4. The tab 4 further comprises a front tab part 7 located near a score line 8. The score line 8 has a circular form extending between the peripheral edge 2 and a central panel part 9 to be removed by actuating and pulling the tab 4.

The tab 4 further comprises a rear tab part provided with a tab opening 11. The rear tab part 10 is intended to be gripped by the user of the can. The tab 4 is generally gripped with two fingers via the tab opening 11 and the free end of the rear tab part with two fingers, or by extending with one finger via the tab opening, or by penetrating beneath the free end 12 of the tab 4 with one finger.

Lifting of the rear tab part 10 will result in a contact of the front tab part near or at the score line 8 thereby popping the score open and forcing an opening. Ultimately by lifting and pulling the tab 4 and moving it upwardly the central panel part 9 will be removed and an opening formed defined by the score line 8.

As shown in FIG. 1, the central panel part 9 has a terrace structure having an outer terrace 13, an intermediate terrace 14, and a central terrace 15.

The panel 1 according to the invention is provided with prevention means 16 for preventing engagement of hooking of an external can structure with the rear tab part. Thereto, the prevention means 16 have the form of 2 elongated embosses 17 and 18 extending spaced apart sidewise of the rear tab part 10. The spacing 19 between the two embosses 17 and 18 is such, that an external can structure is not having such sharp or pointed structures that it could penetrate between the two embosses 17 and 18 into the spacing 19.

The panel 1 is further provided in the central terrace 15 with an indent 20 forming a finger access to be used by the consumer when gripping the free end of the rear tab free end 12 of the rear tab part 10 of the tab 4.

Figure 2:
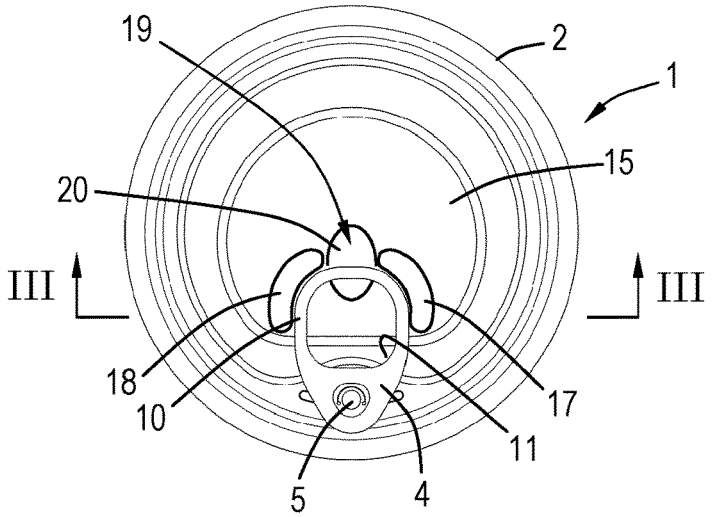
FIG. 2 is a top view of the panel of FIG. 1.

As shown in FIG. 2, the embosses 17 and 18 have an elongated and curved structure which aligns with the outer form of the rear tab part 10.

Figure 3A:
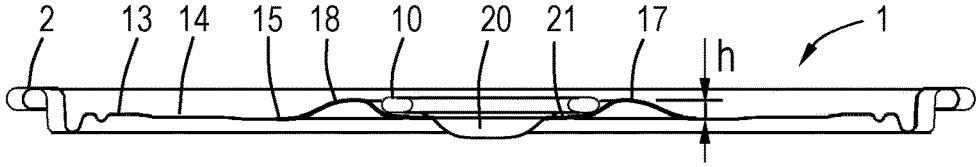
FIGS. 3A and 3B are cross-sections of the line III-III of FIG. 2 of various stages of the panel according to the invention.
Figure 3B:
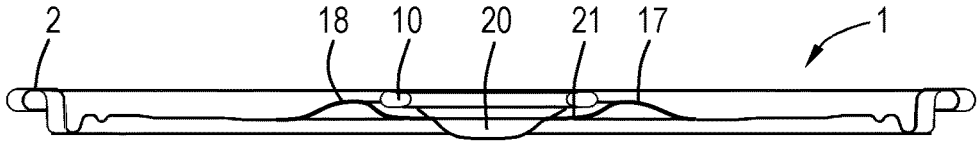

FIG. 3A shows that the two embosses 17 and 18 extend adjacent (not beneath) the rear tab part 10. The height h of the embosses 17 and 18 is such that they are extending over height which is larger than the height of the underside of the rear tab part during production filling cooking and storage. In this respect it is noted that FIG. 3A shows the panel in its original shape during manufacture during which the rear tab part 10 lies on the surface 21 of the central terrace 15. However, after filling and closure of the panel 1 onto the container, as shown in FIG. 3B, then the free end part 10 is extending above the surface 21 leaving a clearance between the free end part 10 and the surface 21. Still, penetration of any external can structure is avoided because the embosses 17 and 18 still extend above the underside of the rear tab part 10 and prevent such penetration.

Figure 4:
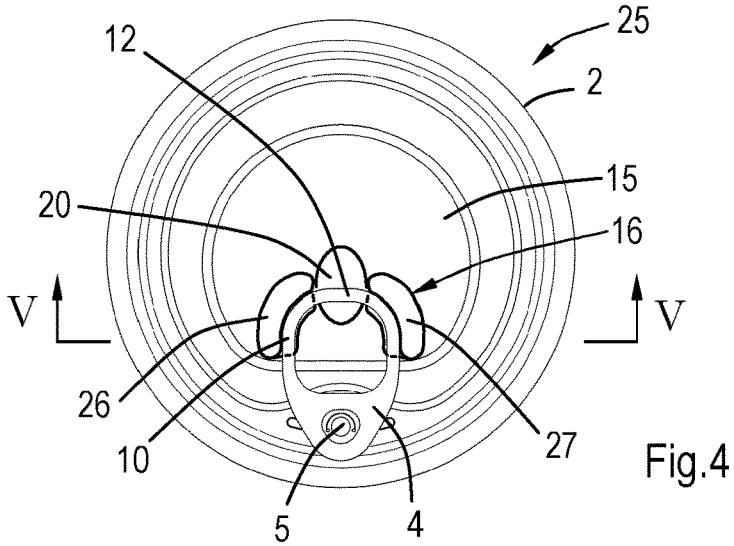
FIGS. 4, 6, and 8 are top views of other panels according to the invention.
Figure 5:
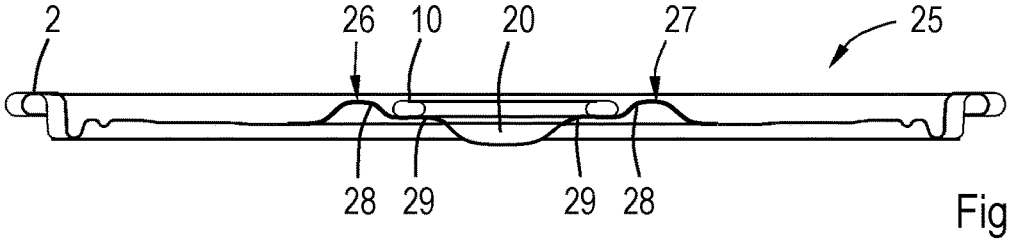
FIGS. 5, 7, and 9 are cross-sections of the panels shown in FIGS. 4, 6, and 8, respectively.

FIGS. 4 and 5 show another panel 25 according to the invention. It is noted that constructural features similar or identical to those of panel 1 as described in FIGS. 1-3 will be referenced by the same reference number.

In this case the terrace 15 is provided with embosses 26 and 27 extending adjacent and beneath the free end part 10 of the tab 4. The embosses 26 and 27 have an elongated and curved structure adapted to the structure of the free end part 10. As shown more clearly in FIG. 7, the embosses 26 and 27 comprise an outer emboss part 28 extending adjacent to the rear tab part 10, and an emboss part 29 extending beneath the rear tab part 10. Thus, the rear tab part is nested in the embosses 26 and 27. Again, the spacing between the embosses 26 and 27 is such that hooking or engagement with an external can structure is avoided. Also is avoided a hooking or engagement along the lateral part of the rear tab part 10.

Figure 6:
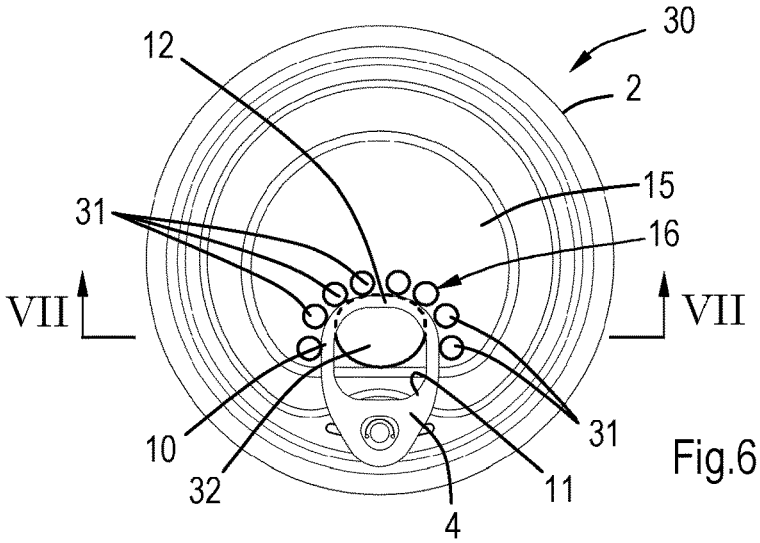
Figure 7:
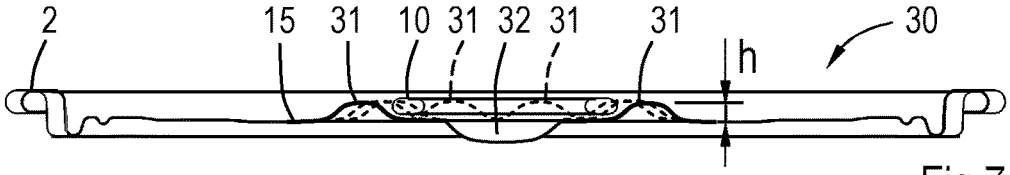
Figure 8:
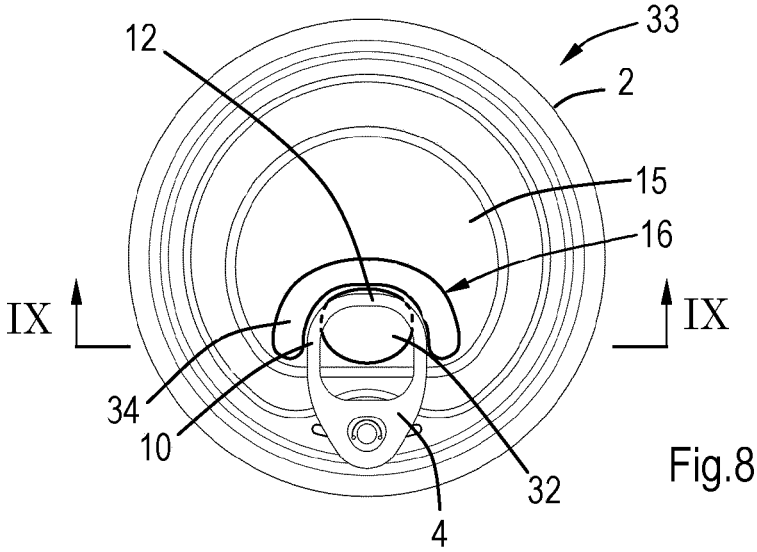

FIGS. 6 and 7 show another panel 30 according to the invention. The panel 30 comprises prevention means 16 according to the invention which have the form of dimples 31 (in total 8) extending adjacent to and along the rear tab part 10 of the tab 4. The height h of the dimples 31 is larger than the height of the underside of the rear tab part 10 but smaller than the height of the upper side of the rear tab part 10. Still, penetration of an external can structure is avoided along the entire outer circumference of the rear tab part 10. Obviously, and similar to the embodiments shown in FIGS. 1-7, the two middle dimples 31 may be removed in order to improve the finger access. Also, the dimples 31 may not only extend adjacent to the rear tab part 10 but may extend also only beneath the rear tab part, or both beneath and adjacent to the rear tab part 10. Still, under all situations the prevention means 16 avoid the engagement or hooking of the external can structure beneath rear tab part 10 of the tab 4. As shown in FIG. 8, the indent 32 extends only within the opening 11 of the tab and beneath the free end 12 of the rear tab part 10.

Figure 9:
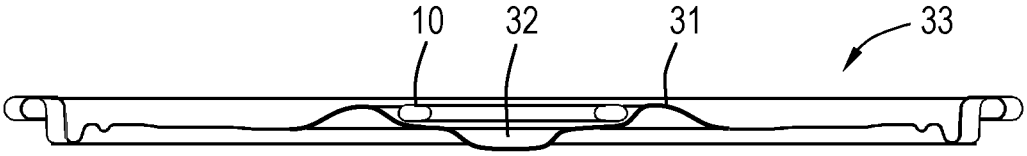

FIGS. 8 and 9 show another panel 33 according to the invention. In this case, the panel 33 is provided with prevention means 16 in the form of an emboss 34 which is elongated and curved in shape, such that the emboss 34 extends generally and substantially along the rear tab part 10 inclusive the free end 12.

Figure 10:
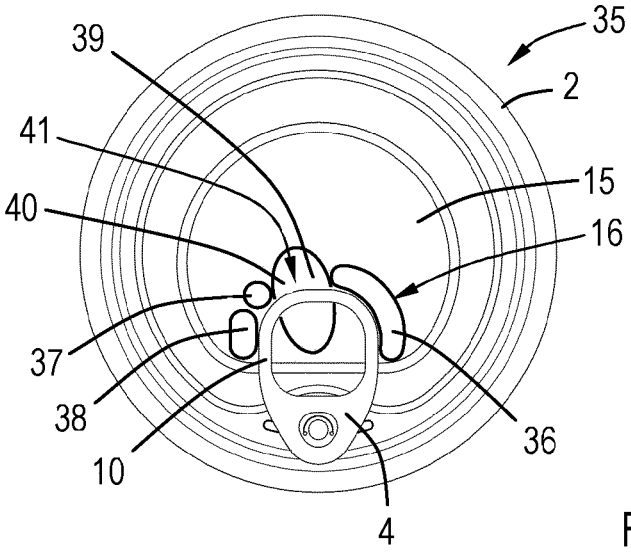
FIG. 10 is a top view of still another embodiment of a panel according to the invention.

FIG. 10 shows another panel 35 according to the invention. The panel 35 is provided in the central terrace 15 with prevention means 16 having the form of an emboss 36 which is curved and elongated, a emboss 37 having the form of a dimple 37, and an emboss 38 which is short elongated and straight. Still, the embosses 36-38 extend along the rear tab part 10 adjacent or at its outside. Between the embosses 36 and 37 is a spacing 39 allowing for a finger access where is also provided an indent 40. It is noted that the prevention means 16 are asymmetrical such that the finger access 41 is also asymmetric which may be elegant for promotion or particular advertisements such as pictures or illustrations formed in at least the central part 15.

Figure 11:
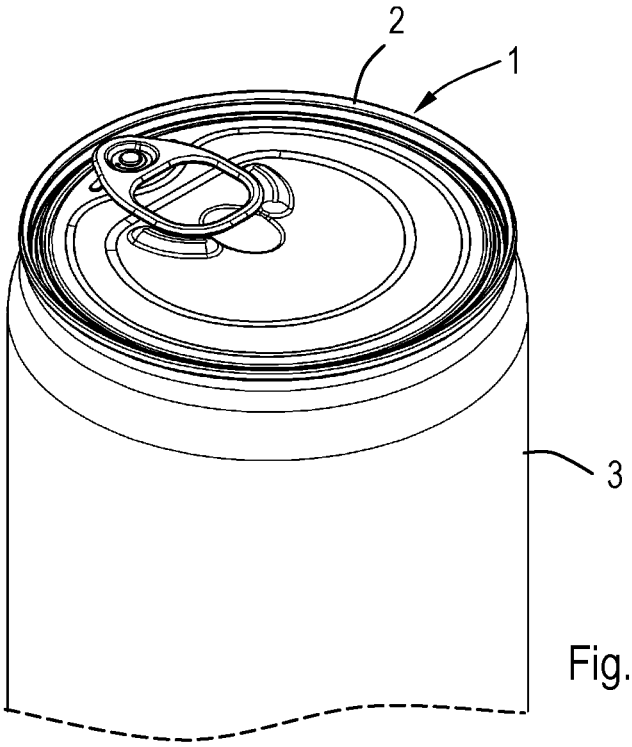
FIG. 11 is a perspective view of a panel according to the invention mounted on a container body.

Finally, FIG. 11 shows the panel 1 mounted with its peripheral edge 2 on a container body 3. The container body 3 may have a bottom or may be without a bottom. With bottom it forms a container according to the invention, and without a bottom allows the filling of the container and subsequently closing the container after having been filled with a (non shown) bottom.

The skilled will appreciate that the panel according to the invention is primarily made of metal, such as aluminum, steel and tinplate. But also suitable plastics or combination of plastic elements and metal elements are in principle suitable. Also the diameter and the thickness of the panel may be selected within wide ranges as long as the function and suitability is not hampered. Thus, a panel diameter in the range of 20-180 mm, such as 35 to 120 mm, like 96 mm is suitable. The thickness dependent on the type of material may be in the range of 0.10 to 2 mm, such as 0.18 to 1 mm or 0.22 to 0.8 mm.

The invention claimed is:

1. A panel comprising a peripheral edge to be connected to a container body of a container, and a tab connected to the panel with a central tab part, which tab comprises a front tab part and a rear tab part spaced from an upper surface of the panel for gripping and by pulling the rear tab part forming an opening in the panel with the front tab part, the rear tab part being oriented towards a center of the panel and the front tab part being oriented toward and near the peripheral edge of the panel, wherein the panel is provided with at least two elongated embosses extending adjacent and beneath the rear tab part of the tab with each of the at least two elongated embosses comprising an outer emboss part extending adjacent to the rear tab part and an inner emboss part extending beneath the rear tab part such that the rear tab part is nested in the two elongated embosses, with the rear tab part resting on the inner emboss part of the two elongated embosses and the outer emboss part of the two elongated embosses extending to a height maximally equal to a height of an upper side of the rear tab part, and wherein a spacing between the two elongated embosses is configured to prevent the external can structure from penetrating beneath the rear tab part while allowing for a finger access for gripping the rear tab part by penetration of a finger beneath the rear tab part.

2. The panel according to claim 1, wherein the height of the rear tab part underside or rear tab part upper side is the maximum height during, production, filling, cooking, and storage of the panel.

3. The panel according to claim 1, wherein beneath a free end of the rear tab part the panel is provided with an indent thereby forming the finger access.

4. A container body provided at a container body end via a peripheral panel edge with a panel according to claim 1.

5. A container comprising a panel according to claim 1.

6. The container according to claim 5, wherein there is a clearance between the rear tab part and the panel.

7. The container according to claim 5, wherein at a negative pressure difference between the inner pressure and the outer pressure there is a clearance between the rear tab part and the panel.

8. The container according to claim 6, wherein at a negative pressure difference between the inner pressure and the outer pressure there is a clearance between the rear tab part and the panel.

9. The panel according to claim 1, wherein the at least two elongated embosses extend over a height that is greater than a height of an underside of the rear tab part and less than a height of an upper side of the rear tab part.

* * * * *